US005444607A

United States Patent [19]

Dreyfuss

[11] Patent Number: 5,444,607

[45] Date of Patent: Aug. 22, 1995

[54] DEVICE FOR ILLUMINATING A BALLOON FOR DISPLAY PURPOSES

[76] Inventor: Raymond Dreyfuss, 3341 N. Hills Dr., Hollywood, Fla. 33021

[21] Appl. No.: 224,474

[22] Filed: Apr. 7, 1994

[51] Int. Cl.[6] ..... A63H 27/10

[52] U.S. Cl. ..... 362/352; 362/96; 362/157; 362/806; 446/220

[58] Field of Search ..... 362/157, 352, 96, 806; 446/220

[56] References Cited

U.S. PATENT DOCUMENTS

| | | | |
|---|---|---|---|
| 4,542,445 | 9/1985 | Marletta | 362/96 |
| 4,794,498 | 12/1988 | Neumeier | 362/186 |
| 5,083,250 | 1/1992 | Malcolm | 362/352 |
| 5,117,344 | 5/1992 | Perez | 362/352 |
| 5,119,281 | 6/1992 | Akman | 362/253 |
| 5,215,492 | 6/1993 | Kubiatowicz | 446/219 |
| 5,295,891 | 3/1994 | Schalk | 362/806 |

FOREIGN PATENT DOCUMENTS

| | | | |
|---|---|---|---|
| 2272170 | 5/1994 | United Kingdom | 446/220 |

*Primary Examiner*—Ira S. Lazarus
*Assistant Examiner*—Sara Sachie Raab
*Attorney, Agent, or Firm*—Malin, Haley, DiMaggio & Crosby

[57] ABSTRACT

A display for mounting and illuminating individual balloons, said display including a battery storage box and a battery mounted therein and a funnel-shaped mount attachable to the battery housing and sized to receive the stem end of a balloon. The balloon mount includes a light bulb, permanently affixed to the inside wall, and wires which proceed down into the battery housing, none of which are exposed when the balloon is mounted in place.

1 Claim, 3 Drawing Sheets

DEVICE FOR ILLUMINATING A BALLOON FOR DISPLAY PURPOSES

BACKGROUND OF THE INVENTION

1. Field of the Invention

This invention relates generally to an illuminated display for advertising purposes, and specifically, to an inflated balloon that acts as a display illuminator for advertising or other display purposes.

2. Description of the Prior Art

The use of illuminated displays in storefronts or other type of advertisements is well known. The use of specialized lighting, Christmas tree lights, and the like is well known in store advertising. Also known is the use of inflatable devices which use accompanying light bulbs for an illumination internally, wherein the entire balloon appears to be illuminated because of a light bulb positioned near the balloon. An illuminated balloon assembly is shown in U.S. Pat. No. 5,117,344, issued to Perez May 26, 1992. In particular, a light bulb is glued or taped to the side wall of a balloon and is then connected to a battery and a set of wires that are tethered relative to the entire balloon when it is inflated. One of the drawbacks of such a device is the fact that the bulb is attached or taped directly to the surface of the balloon where it can be damaged or subject to exposure and damage. U.S. Pat. No. 5,083,250, issued to Malcolm Jan. 21, 1992, shows a floatable balloon light accessory, wherein the light is inserted into the balloon itself. U.S. Pat. No. 5,119,281, issued to Akman Jun. 2, 1992, shows a balloon lighting device and method, wherein again a light bulb is attached into the balloon. U.S. Pat. No. 5,215,492, issued to Kubiatowicz Jun. 1, 1993, shows a light bulb mounted inside a balloon.

The present invention provides for an improvement for an illuminated balloon display by providing a rigid mount for the light bulb that protects the light bulb and permits safety so that the bulb itself is not mounted inside the balloon. This also makes it easier to install and set up and eliminates the need for wires from an electrical power source also mounted inside a sealable balloon.

SUMMARY OF THE INVENTION

A display device that includes illumination for providing an illuminated balloon comprising a rigid battery storage box, substantially rectangular in shape; a cover, removably attachable to said rigid box for protecting said battery, said cover having a cylindrical tube projecting from a central top area outwardly for receiving electrical conductive wires which attach to the battery which mounts inside the original box; a funnel-shaped mount having first and second openings disposed therein for receiving and attaching a balloon to the funnel-shaped mount, said funnel-shaped mount fitting connectably to the top tube on the storage housing; and a small electric light bulb physically mounted to the inside of said funnel-shaped mount and being small enough to allow a balloon to be mounted within the funnel-shaped mount. The size of the funnel opening will accommodate a balloon from approximately 4" to 8" in diameter or larger.

To operate the device, the light bulb can be turned on by opening the battery storage box and connecting the battery terminals to the two wires going to the light bulb so that the light is illuminated.

To utilize the device, a conventional balloon may be blown up, either with helium or ambient air, and tied in a knot at its end in a normal fashion. The end can then be stretched through a first opening in the side of the funnel-shaped mount which receives the base of the balloon where the opening stem is, and a second shaped slot which allows the knot tied in the balloon to be firmly mounted inside the funnel-shaped balloon mount. Once mounted, the balloon will be illuminated by the internal and external reflection and radiation from the light bulb which is flush against the balloon surface while being rigidly mounted to the funnel inside wall. Since the device has a rectangular base in one embodiment, the entire housing with the battery in it permits the lightweight balloon to be positioned where desired with the battery base and housing as a firm mount, allowing the balloon to be displayed vertically.

The battery case may accommodate batteries of any size, but preferably a single-unit, 9-volt battery that fits snugly in the storage compartment that is rectangular in exterior and interior shape, and that has a removable top, through which the battery wires proceed into the base of the funnel, which is also removable.

The light bulb may be very thin, less than $\frac{1}{4}$" in diameter and $\frac{1}{2}$" or $\frac{3}{4}$" in length, and conventional and operates with small batteries of varying voltages. The leads from the light bulb are physically connected to a pair of electrical connectors that have insulated wire or insulation around them for electrical insulation, and are wrapped through the funnel base and the tubular top opening in the battery housing so that all of the devices, the funnel mount and the cover, fit snugly on top of the battery housing.

To activate the device, the cover of the battery housing is removed and the wires are either connected or disconnected, as the case may be, from the light bulb itself to turn the light on and off. This eliminates the need for an additional electrical switch, which would be more costly.

One or more of the devices may be typically used for window displays in stores or other types of advertising displays, or for parties where illuminated balloons would be desirous. By mounting the bulb and the entire electrical and battery network in a single housing that is detachably disconnectable and also serves as a balloon mount, the balloon can be completely separated from the device or attached to the device, without regard for the location of the bulb, safely protecting the bulb and its operation. The battery can easily be replaced if the battery is expended.

It is an object of this invention to provide an improved illuminated balloon display device.

It is another object of this invention to provide an illuminated balloon display that has the bulb and battery assembly protected.

And yet another object of this invention to provide an improved illuminated balloon that includes a mount for mounting the balloon firmly to a balloon mount attached to the device.

And yet still another object of this invention is to provide an illuminated balloon display that is safe in operation, that has no wires, bulbs, or battery exposed, and wherein the balloon can be easily separated or attached to the device.

In accordance with these and other objects which will become apparent hereinafter, the instant invention will now be described with particular reference to the accompanying drawings.

DESCRIPTION OF THE PREFERRED EMBODIMENTS

Figure 1:
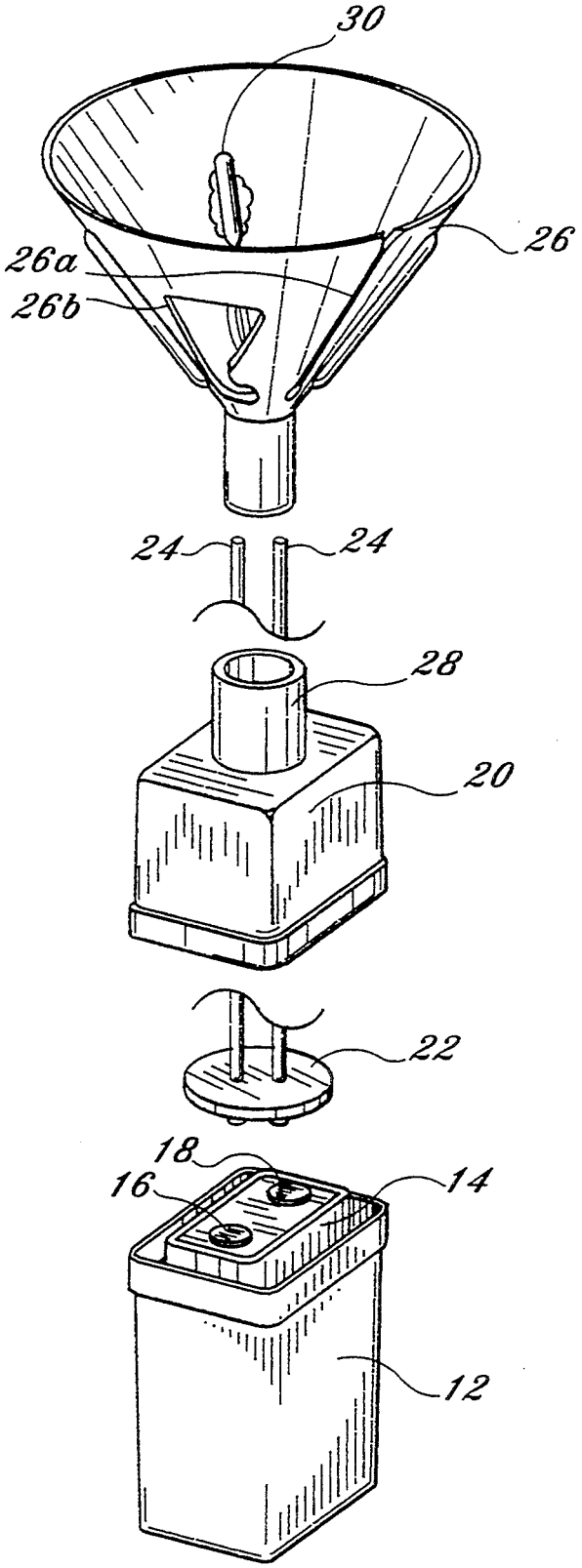
FIG. 1 shows an exploded view in perspective of the present invention.

Referring now to the drawings, and in particular, FIG. 1, the present invention is shown generally at 10 in an exploded view that includes a small, plastic, rectangular battery storage box 12 that may be made of a molded plastic, having a cover 20 that snugly fits on top of battery storage box 12 in the closed position.

Inside battery storage box 12 is a battery 14 that has a pair of electrodes 16 and 18, all of which is conventional.

Cover 20 also has, unitarily molded therethrough, a vertical tube rigidly molded at one end and extending upwardly with a conduit 28*a* proceeding therethrough. The purpose of the vertical tube is to support a funnel-shaped balloon mount 26 in its uppermost opening, while at the same time permitting electrical conductive wires 24 to be disposed therethrough, terminating at one end with a connector cap 22 that allows the electrodes 16 and 18 to be connected to the wires 24 and the wires 24 connected at their other end to a light bulb 30 that is glued inside balloon mount 26. The diameter of the base of the funnel, which is a small cylinder 26*c*, fits within the opening at the top of conduit 28 connected to cover 20.

The balloon mount 26 includes a first triangular-shaped wall aperture 26*b* near its base and a slot 26*a* projects from the uppermost lip of the cone downward toward its base longitudinally. The wall aperture 26*b* and the slot 26*a* are used to secure a balloon (not shown in FIG. 1) to the balloon mount 26. Once a balloon has been blown up and conventionally tied at one end to seal the air inside, there is a certain elasticity which will allow the balloon to be pulled down at its base, where the opening of the balloon is, into the balloon mount 26 with the knot tied in the balloon pulled through wall aperture 26*b* and then stretched up through slot 26*a* down inside balloon mount 26 to firmly hold the balloon in place. The elastic tension on the balloon acts to hold the knot against slot 26*a*. Note that light bulb 30 is glued firmly to the inside of balloon mount 26.

Figure 2:
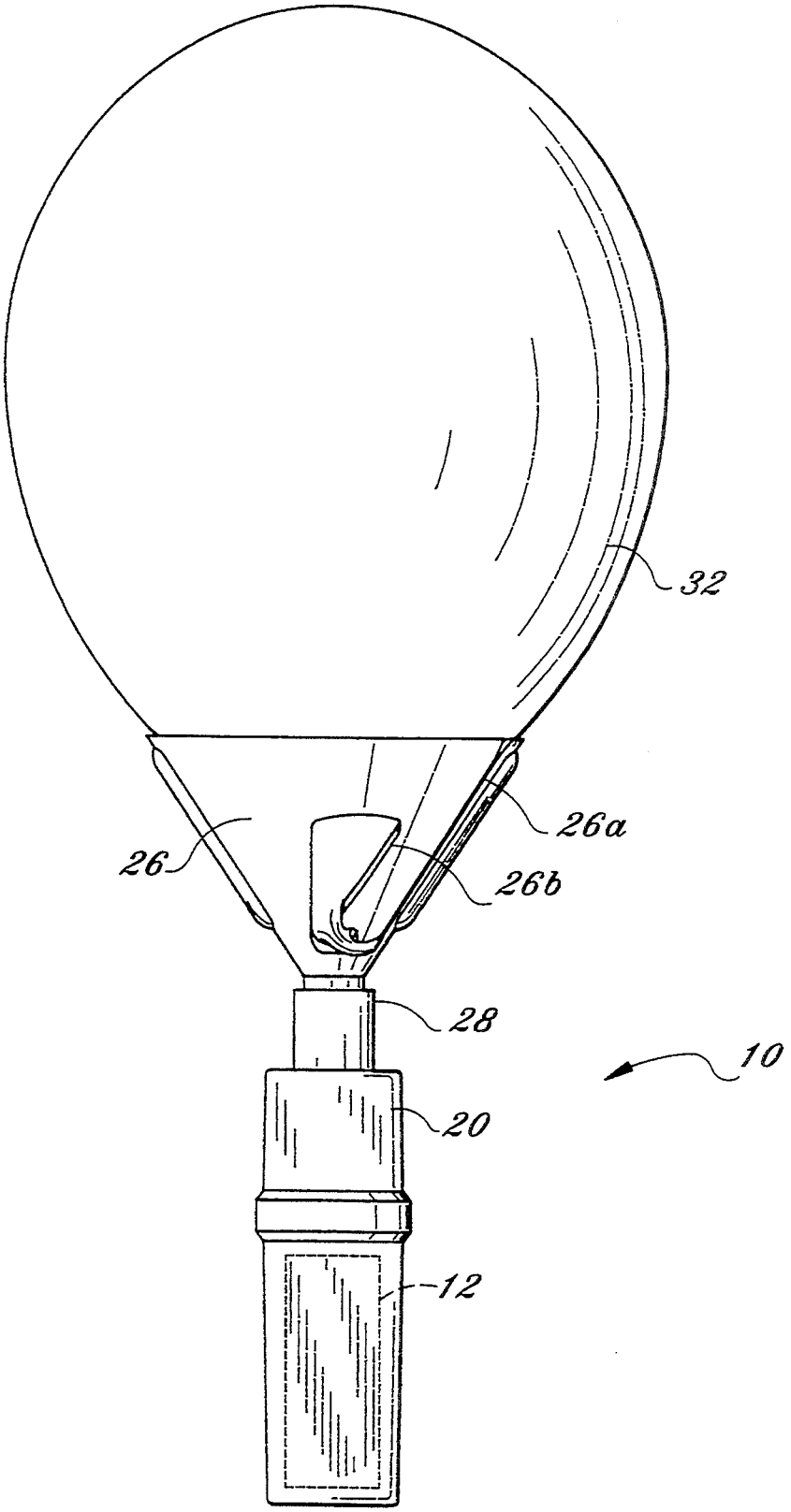
FIG. 2 shows a side elevational view of the present invention with the balloon attached.

FIG. 2 shows the invention 10, including a balloon 32 that has been mounted into balloon mount 26 in its operating position. The battery storage box 12 has cover 20 attached firmly thereto so that none of the wires are exposed when balloon 32 is in place and light bulb 30 is not exposed. In this position, as shown in FIG. 2, with the electrical connectors and wires connected to the battery inside battery storage box 12, light bulb 30 will be illuminated, causing balloon 32 to be illuminated.

In order to operate the invention, cover 20 is removed from the battery storage box 12, which allows access to the battery connector for the light bulb so that the connecting wires can be attached to the battery electrodes and the cover put back in position. The light bulb will then be illuminated. To turn the light bulb off, cover 20 is removed and the wires are separated from the battery connectors. Note that the balloon can also be removed very quickly and easily using the slot 26*a* and wall aperture 26*b*.

Figure 3:
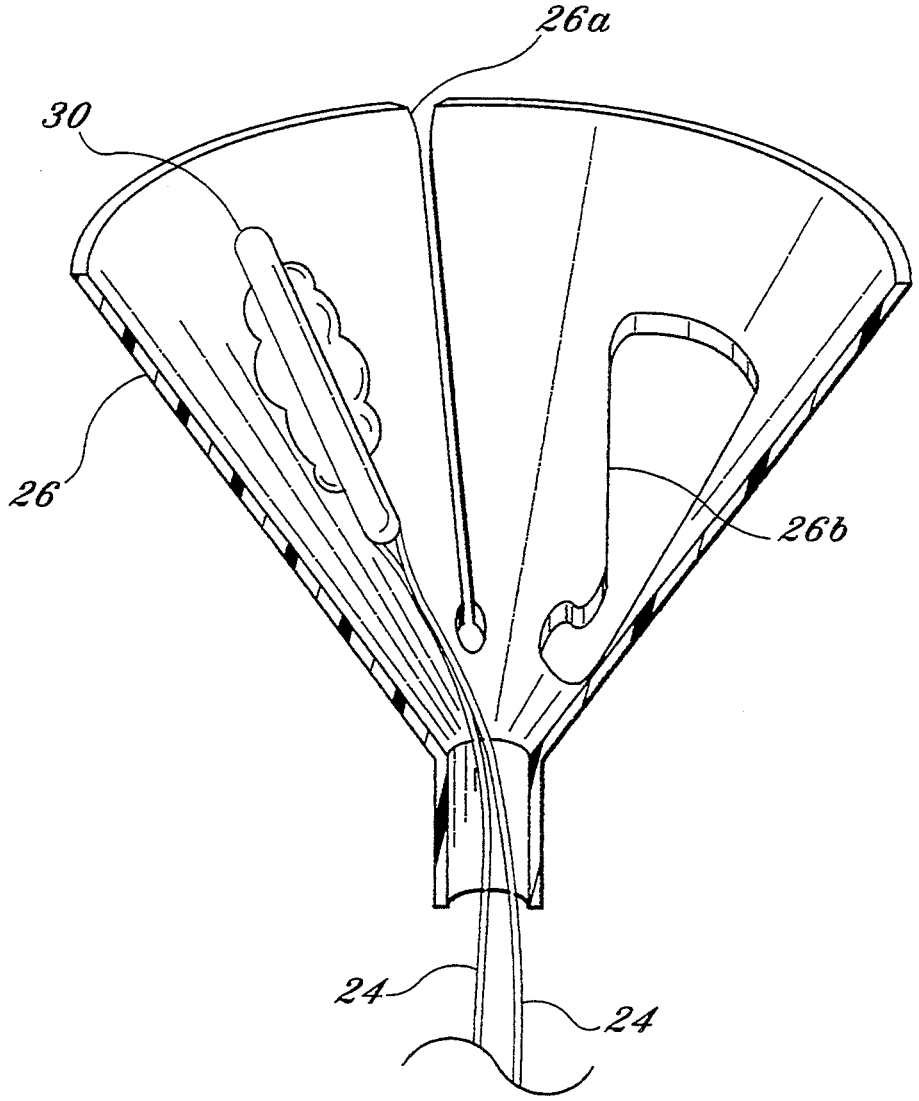
FIG. 3 shows a partially cut away side elevational view showing the bulb mounted to the funnel-shaped balloon mount and the balloon mount openings.

FIG. 3 shows the funnel-shaped balloon mount, partially cut away, that shows wires 24 going to light bulb 30, the light bulb being glued by adhesive 34 to the inside side wall. The funnel inside side wall can also have a groove 26*d* that accommodates and fits light bulb 30 to make it more snug inside the balloon mount 26. As noted, the balloon mount 26 also includes slot 26*a* that receives and holds balloon 32 in place and wall aperture 26*b* that allows balloon 32 not to be passed therethrough and back into slot 26*a* on the inside, holding the knot. The exterior diameter of cylinder 26*c* is smaller than the inside diameter of conduit 28 that is affixed to the rigid top of cover 20. It is important to realize that light bulb 30 is thus secured firmly to the inside wall of balloon mount 26, along with wires 24 so that no electric wires or light bulbs are exposed outside of the device, especially when a balloon is mounted thereto. The entire device acts as a stable platform to support the balloon in a vertical position.

Several of the devices may be employed for an overall advertising display, using a plurality of illuminated balloons which can be easily positioned around a given location. Typically, a 9-volt battery could be used with the appropriate, very narrow, slender light bulb 30 that fits into an inside groove 26*d*. Note that when the balloon is in position, it will be flush against light bulb 30, but will not be in any way attached to the light bulb.

The instant invention has been shown and described herein in what is considered to be the most practical and preferred embodiment. It is recognized, however, that departures may be made therefrom within the scope of the invention and that obvious modifications will occur to a person skilled in the art.

What is claimed is:

1. An illuminated balloon display, illuminating an inflated balloon with a light bulb, said display being portable, comprising:

a battery storage box having a top opening;

a battery removably mounted within said battery storage box;

a battery storage box cover, having a top side and a central aperture, removably attachable to said top opening in said battery storage box;

a cylindrically shaped connector having a first end and a second end, said cylindrically shaped connector having an internal passageway disposed therethrough and rigidly attached at said first end to the top side of said cover, said cylindrically shaped connector passageway communicating with said cover central aperture;

a balloon mount having a funnel shaped wall, said funnel shaped wall having a first end and a second end, said funnel shaped wall having an interior wall surface and an exterior wall surface, said interior wall surface being sized for receiving an inflated balloon, said funnel shaped wall including at least one longitudinally disposed light bulb groove sized to receive a portion of a light bulb, said funnel shaped wall including a cutout and a slot within said wall in spaced relation to each other, said slot originating at said balloon mount funnel shaped wall first end and extending longitudinally toward said funnel shaped wall second end;

means for connecting said balloon mount at the second end of said funnel shaped wall removably to said cylindrically shaped connector to the top side of said cover connected to the second end of said funnel shaped;

an inflated balloon, said balloon having an elastic membrane body incorporating a filling stem with a knotted end, said balloon attached to said balloon mount by passing said knotted end through said balloon mount cutout, said balloon stem and knotted end secured by said balloon mount slot against said balloon mount interior surface;

a pair of electrical conductive wires having a pair of first ends and second ends; and a battery connector connected to the second ends of said electrical conductive wires, said battery connector sized for being connected to said battery when said battery is mounted inside said battery box, said light bulb being electrically connected to said battery by said electrical conductors at said first ends, whereby said balloon is illuminated by said light bulb, said light bulb being firmly affixed to the light bulb groove of said balloon mount.

* * * * *